United States Patent [19]

Stofan

[11] 3,969,462

[45] July 13, 1976

[54] POLYESTER YARN PRODUCTION

[75] Inventor: Richard H. Stofan, Shelby, N.C.

[73] Assignee: Fiber Industries, Inc., Charlotte, N.C.

[22] Filed: Nov. 7, 1974

[21] Appl. No.: 521,726

Related U.S. Application Data

[62] Division of Ser. No. 160,019, July 6, 1971, Pat. No. 3,858,386.

[52] U.S. Cl. ..... 264/237; 264/176 F; 264/210 F

[51] Int. Cl.[2] ..... B29C 25/00

[58] Field of Search ..... 425/72; 264/176 F, 237, 264/168, 210 F

[56] References Cited

UNITED STATES PATENTS

| | | | |
|---|---|---|---|
| 2,847,704 | 8/1958 | Scheers | 264/176 F |
| 3,053,611 | 9/1962 | Griehl | 264/176 F |
| 3,135,811 | 6/1964 | Barnett et al. | 264/176 F |
| 3,361,859 | 1/1968 | Cenzato | 264/176 F |
| 3,705,227 | 12/1972 | Fintel | 425/72 |

FOREIGN PATENTS OR APPLICATIONS

| | | | |
|---|---|---|---|
| 671,890 | 10/1963 | Canada | 264/176 F |
| 957,534 | 5/1964 | United Kingdom | 264/176 F |

*Primary Examiner*—Jay H. Woo
*Attorney, Agent, or Firm*—Herbert M. Adrian, Jr.

[57] ABSTRACT

A method and apparatus are disclosed for the production of a novel industrial polyester filament yarn of improved uniformity wherein a plurality of filaments are melt-spun into a heated zone coupled with controlled cooling. The yarn produced has improved long and short term Uster uniformity and improved uniformity of physical properties, particularly breaking strength, as shown by a reduced standard deviation of breaking strength. The yarn is produced by melt spinning into a heated zone which maintains the filaments molten for intervals below the spinneret face and subsequently quenching the filaments with a radial outflow of cooling gases, thereby producing a low birefringence yarn which is capable of being drawn at high draw ratios to high tenacities.

10 Claims, 3 Drawing Figures

POLYESTER YARN PRODUCTION

This is a division of application Ser. No. 160,019, filed July 6, 1971 and now U.S. Pat. No. 3,858,386.

BACKGROUND OF THE INVENTION

In the production of polyester industrial yarn, often referred to as heavy denier continuous filament yarn, it has often been the practice to produce undrawn filaments of low birefringence such that high draw ratios can subsequently be utilized, thereby obtaining the highest degree of molecular orientation and consequently high tenacities. Such high orientation contributes to the high tenacity of the resulting fibers. It was previously discovered that polyester fibers of low birefringence can be most highly oriented in subsequent drawing steps, but that as filament spinning speeds increase, birefringence tended to increase because of the induced orientation of the filament which occurs in the rapid takeup of the yarn. This results in increased pulling tensions on the yarn in the spinning column, i.e., increases in column draw down. To alleviate the draw down in the column, various procedures have been incorporated into the spinning, including higher extrusion pressures and means for maintaining the filaments molten for a period of time after extrusion. The filaments on quenching and drawing, while achieving high tenacities and modulus and desirable elongations, are found to be deficient in uniformity as measured in percent Uster. This results in a higher standard deviation for the physical properties, such as breaking strength, which is of most critical importance to industrial yarn.

It is therefore an object of the present invention to describe a method for producing a heavy denier industrial polyester yarn of improved uniformity of physical properties.

It is another object of the present invention to provide apparatus for spinning such polyester filament yarns.

It is another object of the present invention to provide a heavy denier industrial polyester filament yarn of high tenacity, improved long and short term percent Uster values and lower standard deviation in breaking strength.

These and other objects will become apparent to those skilled in the art from a description of the invention which follows.

DESCRIPTION OF THE INVENTION

In accordance with the invention, a method is provided for producing an industrial polyester filament yarn of improved uniformity comprising melt spinning a plurality of filaments at an extrusion temperature above the polymer melting point into a heated zone maintained at a temperature of 260° – 460°C., maintaining said filaments in said heated zone for filament travel distance of about 6 to 24 inches and hence, immediately passing said filaments about a gaseous quenching zone, directing quenching gases onto said filaments in a radial outward flow direction, said quenching gas being maintained at a temperature of about 15° to 50°C. in a gaseous volume of about 20 to 130 standard cubic feet per minute to provide a controlled cooling of said filaments and taking said filaments up as a yarn of improved Uster uniformity.

The heavy denier industrial polyester filament yarn produced in accordance with this invention has a denier per filament of 3 to 20, a tenacity of more than 7.0 grams per denier, a long and short term percent Uster of less than 1.5, and more preferably a long term percent Uster of less than 1.0, a tensile factor ($TE^{1/2}$) of more than 28 and a breaking strength standard deviation of less than 0.20 grams per denier as measured in yarns across a beam.

The improved uniformity of the yarn is achieved primarily through the utilization of controlled temperature conditions from immediately adjacent to the extrusion point to the cooling of the filaments to a temperature below their second order transition temperature. The improvement is not only highly pronounced in Uster uniformity, but also in reduction in the average standard deviation of physical properties, particularly tensile strength. It is also noticeable in the reduction of both major and minor beaming defects as noted by Lindley defect counting at beaming.

DETAILS OF THE INVENTION

The invention will be more fully described by reference to the drawings wherein.

Figure 1:
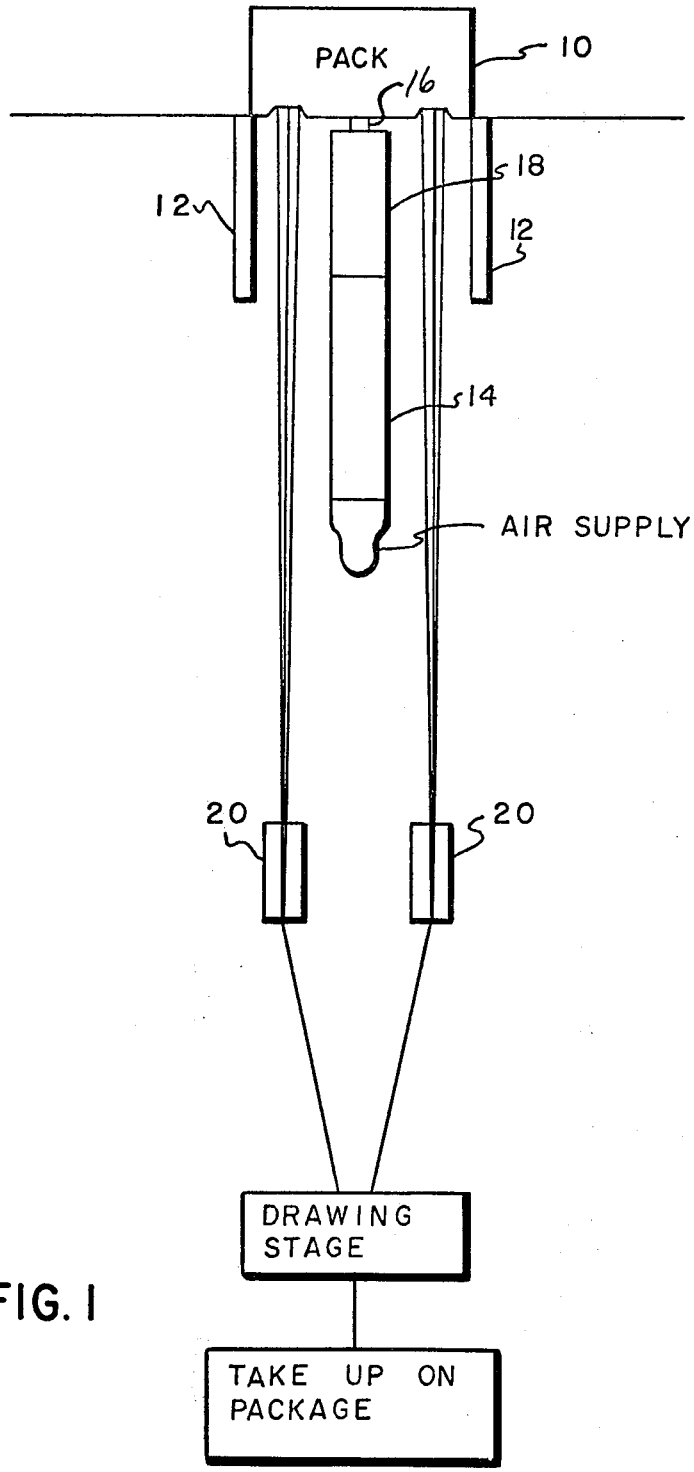
FIG. 1 is a front elevational and partial schematic of the apparatus of the present invention showing more particularly the relationship of the extrusion heated zone and quenching apparatus in a spinning column.

Referring more particularly to FIG. 1, the schematic drawing of spinning pack 10 is representative of a standard polyester pack which includes final filtration means for the polymer and a spinneret with a preselected number of holes for the extrusion of polymer. The polymer conveyed to the pack is maintained at a spinning temperature which is normally comfortably above the melting temperature of the polymer, i.e., about 257°C. for polyethylene terephthalate. Thus, spinning temperatures are normally in the range of about 290° to 310°C. The spinneret utilized is selected in accordance with the denier and filament count of the yarn being produced. If desired, one or more yarns can be spun from a single pack in a single column as illustrated in the drawing.

The spinning speed varies with the particular process and fiber type being spun, but generally is in the range of 2,000 to 10,000 feet per minute or more at wind up in a spin-draw process.

The molten polymer, as it is extruded from pack 10, immediately enters a heated zone which is maintained at an elevated temperature by a heated cylindrical shroud 12 which preferably is positioned adjacent to pack 10 and extends downwardly into the spinning column for a distance of about 6 to 24 inches. The shroud has an internal diameter of sufficient size to permit safe passage of the filaments therethrough without danger of contact with the heated shroud. Conveniently, leeway of one to several inches of distance is provided between the outside filament travel line and the inside diameter of the shroud. The shroud is heated preferably by internal heating means such as electrical resisters, circulating fluids or the like conventional heating means to produce an internal surface temperature on the shroud in the range of 260° to 460°C., and more preferably 300° to 360°C. Such shroud temperatures provide a heated zone of temperatures slightly less than the surface temperature, but because of heat radiated from the spinning pack and molten extrudate, a temperature near that of the shroud is readily maintained. The exact temperature utilized is primarily dependent upon the size of the shroud, distance away from the filaments, heat loss from the shroud area, filament denier, polyester type and the like considerations. The temperature selected is one sufficient to maintain the as-spun polymer in a molten condition as it passes through the shroud area.

Immediately adjacent to the lower section of heated shroud 12 is outflow quench stick 14. Quench stick 14 is centered among the filaments and positioned by means of positioning guide (piece pin) 16 in a central location under the pack and spinneret. The filaments are guided down the quench stick so as not to come in contact therewith, but to spread the filaments uniformly around the quench stick. Quench stick 14 is positioned by means of positioning guide 16 and spacer 18, so as to conveniently position each quench stick in the same location in a plurality of packs and spinning columns.

The quench stick preferably extends into the area of the heated shroud so as to provide a controlled cooling immediately as the filaments exit from the shroud. As will be appreciated by those skilled in the art, the rapid passage of fibers down the spinning column creates a downward draft of convection currents which tends to carry both the heat of the shroud and the cooling effect of the quench gases downwardly along the filament path of travel. Therefore, by utilizing the preferred quench stick positioning, the most desirable control of cooling is obtained.

The quench stick is preferably made of a porous material, such as ceramic, or sintered metal in a manner which provides a predetermined, even flow of air throughout the length and circumference of the stick. Such quenching sticks are commercially available in a variety of porosities suitable for this application.

Figure 3:
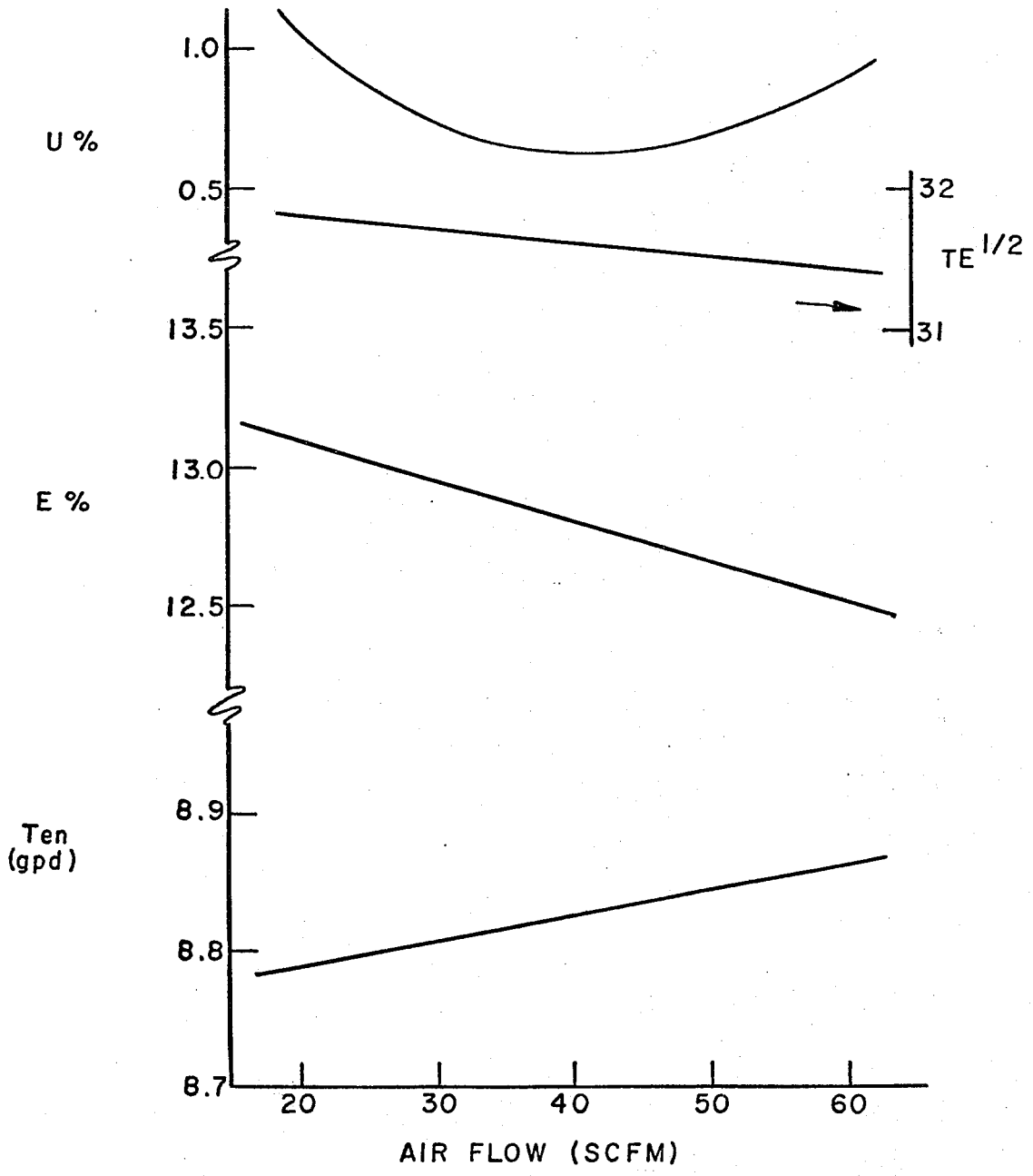
FIG. 3 is a graph which relates long term Uster, elongation, tensile factor ($TE^{1/2}$) and tenacity with various quench gas flow rates.

The air flow through the quench stick affects the quality of the yarn produced and therefore, for a given spinning process a preferred gas flow, e.g., air, results in the most desirable spinning. It has been found that the air flow as measured in standard cubic feet per minute (SCFM) is proportional to the total denier of the yarn being spun and the spinning speed with higher total deniers and higher speeds requiring higher flow rates. For instance, the air flow is in a gas volume of about 20 to 130 SCFM with the preferred air flow in the range of about 20 to 60 SCFM. This is more clearly illustrated in FIG. 3 which relates changes in yarn physical properties with changes in air flow rates for a 1000/192 industrial yarn. It will be noted from this graph that the best results for this yarn at a 5.8 draw ratio is an air flow of about 40 SCFM.

Ambient quench gas temperatures have been found to be satisfactory, although in the compression of the gas, a temperature rise is often unavoidable. Therefore, under certain climatic conditions, it may be desirable to cool such gases so as to preferably utilize a quench gas temperature within the range of 15° to 80°C., and more preferably about 25° to 50°C.

The quench stick length and diameter are selected in accordance with the spinning speed, filament count, total denier, air flow desired and the like parameters, so as to provide controlled cooling of the yarn in the manner described herein. In a preferred embodiment, such quench sticks are normally of a diameter of about 1½ to 4 inches and a length of about 8 to 20 inches.

Upon quenching the filaments, a spin finish is applied and the filaments drawn and taken up on a package as a finished yarn or alternatively, taken upon a package in an undrawn state. In accordance with the present invention, it is preferable to split the threadline into two or more portions and apply the finish separately to each of the portions, such as by utilizing dual finish rolls 20. It has been found that it is particularly important to insure that the as-spun filaments do not touch any portion of the spinning column or apparatus until the application of the spin finish. Therefore, the split threadline and multiple or dual finish applicators are particularly important to insure that stray filaments do not come in contact with items such as the quench stick or air supply therefor. As is often desired in using a split threadline quench, the yarns may be retained separately and taken up or drawn separately. Alternatively, the split threadlines can be recombined at the drawing stage and taken up as a single yarn.

While it has been described that the yarns may be taken up on a package after the application of the spin finish, it is normally most desirable in a modern polyester production plant to immediately thereafter draw the yarn in one or more stages under known drawing conditions and heat set and/or relax the yarn if desired prior to taking the yarn up as a finished product. In industrial yarns, to which the present invention is primarily concerned, yarns are normally drawn at the highest achievable draw ratio which can be successfully processed in continuous operation. Thus, draw ratios in excess of 3, and more preferably on the order of 4 to about 6.5 to 1 are preferably utilized with multi-stage drawing being the preferred method of operation. The actual total draw ratio utilized is dependent upon the as-spun birefringence which, as noted above, is preferably as low as possible so as to achieve the highest draw ratio. Thus, such drawn yarns have tenacities in excess of 7 grams per denier, and more preferably, in the range of 8 to 11 grams or more per denier.

Tensile factor, i.e., $TE^{1/2}$, is determined by multiplying the tenacity in grams per denier times the square root of the elongation at break. The yarns produced in accordance with the present method have tensile factors greater than 28 and more preferably, greater than 30. Typically, the range of tensile factor is between 28 and 40.

The yarns of the present invention are preferably high tenacity industrial yarns such as tire yarns, conveyer belt yarns, sewing threads and the like, having denier per filaments of at least 1.0 and more preferably 3.0 to 20 or more. Total drawn deniers of such yarns range from about 100 to 10,000 with most yarns having total deniers of about 500 to 3,000. All of such yarns are considered to be heavy deniers.

As has been noted above, the long, i.e., inert, and the short, i.e., normal, percent Uster of yarns produced in accordance with the present invention is less than 1.5, and more preferably less than 1.0. The Uster is measured in accordance with Uster Evenness Tester, Model GGPC 10, in accordance with the manufacturer's recommended procedure, with the proviso that a feed tension of 25 grams is utilized on the yarn and a yarn feed rate of 25 yards per minute is fed to the tester for at least 3 minutes. The rotofil setting of the tester is placed at number 3 for conventional industrial yarns.

The breaking strength standard deviation ($\sigma$) of yarns produced in accordance with the present invention is also substantially improved over previous industrial yarn processes. Such breaking strength standard deviation is less than 0.20 grams per denier between position-to-position yarns and most preferably, less than 0.15 grams per denier, when measured in accordance with ASTM Method D885-68. The standard deviation is calculated based upon the testing of at least 15 samples of yarn from position-to-position across production machines. It is often more convenient to measure the standard deviation of the yarns across a beam and such yarns fall within the specified range.

With the improved uniformity of the yarns produced in accordance with the present invention, marked improvement will be noted in major and minor defects in beaming as compared to previously produced yarns.

The preferred polyesters used in this invention are obtained from terephthalate acid via any of the known polymerization routes, i.e., ester interchange, direct esterification, BHET and the like, wherein at least 75% of the recurring structural units of the polyester are glycol terephthalate structural units. The polymers used are fiber forming and preferably of an intrinsic viscosity of at least 0.45 up to 1.00 or more as measured in 8% orthochlorophenyl at 25°C.

As conditions for heat setting, a temperature of 120° – 300°C. and a time of 0.01–2 seconds may be adopted.

While polyester polymer used in the present invention preferably contains at least 75 mol percent of ethylene terephthalate units and as other acid components when used, a dibasic acid such as phthalic acid, isophthalic acid, adipic acid, oxalic acid, sebacic acid, suberic acid, glutaric acid, pimelic acid, fumaric acid and succinic acid may be used. A polymerization degree modifier like propionic acid may be used. As alcohol component, a divalent alcohol such as polymethylene glycol having 2–10 carbon atoms (trimethylene glycol and butylene glycol) and cyclohexane dimethanol may be cited. And they may contain a small amount of the following compound as a modifier, 5-oxydimethyl isophthalate, 5-oxydimethyl hexahydroisophthalate, benzene-1,3,5-tricarboxylic acid, para-carbomethoxy phenyl diethyl phosphonate, 3,5-dicarboxy phenyl diethyl phosphonate, pentaerythritol, glycerol, glucose, phosphoric acid, triphenyl phosphate, tri-p-carbomethoxy phenyl phosphate, triphenyl phosphinate, triphenyl arsenite, tricapryl borate, sorbitan, trimesic acid, diethylene glycol and the like.

The following examples illustrate certain preferred embodiments of the present invention. Unless otherwise indicated, all parts and percentages used herein are by weight and all temperatures are in degrees centigrade.

EXAMPLE I

Polyethylene terephthalate was produced in accordance with a continuous polymerization process to provide a molten polymer having an intrinsic viscosity of 0.88, as measured in the final product, which was fed directly to a spinning pack and apparatus in accordance with FIG. 1. The polymer was spun at a spinning temperature of 297° to 300°C. at a rate of 30.9 pounds per hour. The yarn spun was 1000/192 yarn utilizing a split threadline wherein one-half the filaments were split on either side of the quench stick. A spin finish was applied utilizing dual finish applicator rolls and the yarn recombined for drawing in a spin-draw process. The yarn was drawn to a total draw ratio of 5.8.

Figure 2:
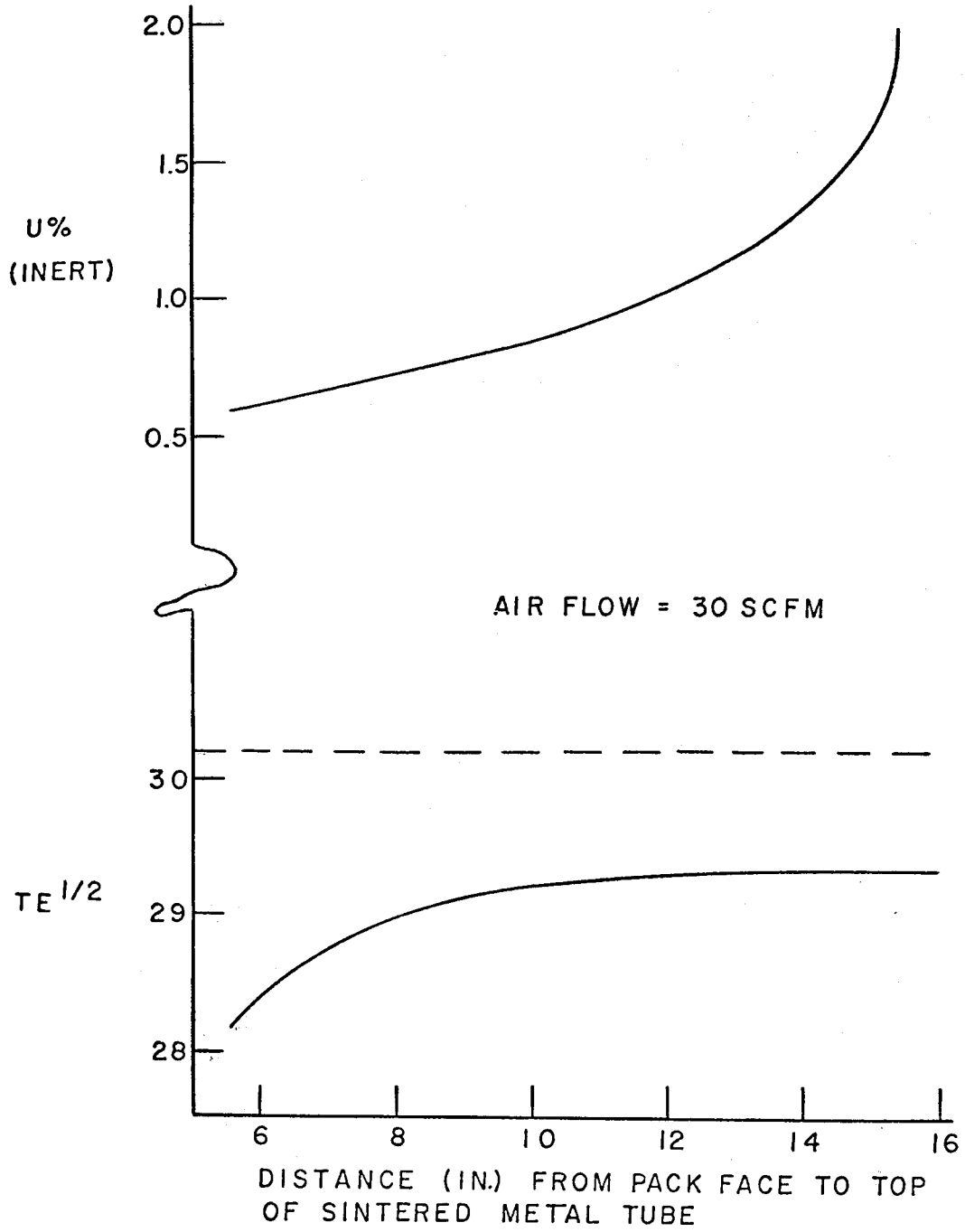
FIG. 2 is a graph which illustrates the relationship between the quenching distance from the spinneret face as it relates to long term Uster values and tensile factor ($TE^{1/2}$)

During the spinning of the yarn, various parameters with respect to the outflow quench system and heated shroud were changed to determine the effect on the yarn properties. In accordance with FIG. 2, the distance of the initiation of outflow quench from the spinning pack was varied from 6 inches to 16 inches, and the effect on tensile factor and percent Uster (inert), i.e., long term, was measured. The spinning was carried out at a set quench air flow of 30 SCFM. The results are graphically illustrated in FIG. 2.

The experiments were continued in the same manner with the spinning at a rate of 30.9 pounds per hour, the outflow quench distance being approximately 10 inches from the spinning pack, quench air temperature at about 40°C., the pack to outflow spacer distance being three-quarters of an inch, and the shroud temperature at 320°C. With these preset conditions, the air flow was varied from 20 SCFM to 60 SCFM to determine the effect on percent Uster (inert), tensile factor, i.e., $TE^{1/2}$, percent elongation at break (E), and tenacity in grams per denier (gpd). These effects are shown graphically in FIG. 3.

While variations in the noted spinning parameters have the noted effects on the yarn quality and spinning performance, it should be noted that this Example illustrated the preferred parameters for 1000/192 yarn in a spin-draw process. As will be appreciated by those skilled in the art, changes in the polymer being spun, the particular denier thereof, and the like, will affect the preferred operating conditions such as by shifting the various curves in the graphs of FIGS. 2–3 to the right or left as the case may be. Such changes in these spinning parameters to obtain the most preferred conditions for a given yarn will be readily ascertained from the guidance and exemplification given herein.

EXAMPLE 2

The process of the present invention was compared to standard production spinning processes which included the use of a heated shroud at a temperature of 320°C., but without an outflow quench. The spinning process utilized 0.88 intrinsic viscosity polyethylene terephthalate, a spinning rate of about 31 pounds per hour, a spin-draw procedure at a total draw ratio of 6.08 to produce a 1020/192 yarn. The percent Uster of standard production yarn utilizing the heated shroud was then compared with the process of the present invention wherein the heated shroud was utilized at the same temperature but combined with the outflow quench of the air flow of 40 SCFM, a quench air temperature of about 40°C., and a quench distance of about 10 inches from the spinning pack. All other conditions were the same as the comparison. The standard production yarn had a percent Uster (inert) of 2.3, whereas the yarn of the present invention had a percent Uster (inert) of 0.5.

The breaking load of the yarn of the present invention was 9072 grams. Standard deviation of breaking load in position-to-position, as measured in yarns across a beam was 0.15 grams per denier. The standard production yarn had a breaking load of 9096 grams, with a standard deviation in breaking load in position-to-position, as measured in yarns across a beam, of 0.21 grams per denier. The number of major and minor defects in beam of these yarns was found to be significantly reduced in the yarns of the present invention compared to the standard production.

EXAMPLE 3

In the same manner as Example 2, 1330/192 yarn was produced in accordance with the present invention and compared to standard production yarn which utilized a heated shroud. The percent Uster (inert) was 0.8 for yarn of the present invention. Standard production yarn had a percent Uster (inert) of 2.0. The standard deviation of the yarn of the present invention was 0.14 grams per denier, whereas the standard deviation of standard production yarn was 0.18 as measured in yarns across a beam.

The tenacity of the yarn of the present invention was 8.90 and $TE^{1/2}$ was 31.3. The tenacity of standard production was 8.84 and $TE^{1/2}$ was 30.2.

What is claimed is:

1. A method for producing an industrial polyester filament yarn of improved uniformity comprising melt spinning a plurality of filaments at an extrusion temperature above the polymer melting point into a heated zone maintained at a temperature of about 260° to 460°C., and maintaining said filaments in said heated zone for a filament travel distance of about 6 to 24 inches, and hence immediately passing said filaments about a gas quenching zone, directing quenching gas onto said filaments in a radial outflow direction, said quenching gas being maintained at a temperature of 15 to 80°C. in a gas volume of 20 to 130 standard cubic feet per minute being exhausted radially along a distance of about 8 to 20 inches of a peripheral diameter of 1.5 to 4 inches to provide a controlled cooling of said filaments and taking up said filaments as a yarn of improved Uster uniformity.

2. The method of claim 1 wherein the filaments after quenching have applied thereto a spin finish and are drawn at a draw ratio of more than 3.0 prior to being taken up on a package.

3. The method of claim 2 wherein the draw ratio is within the range of 4 to 6.5 to 1.

4. The method of claim 1 wherein the volume of quenching gas is dependent on the total denier of the yarn being spun, said gas volume being a higher volume for higher deniers.

5. The method of claim 4 wherein the quenching gas volume is about 40 standard cubic feet per minute for 1000 total denier yarn.

6. The method of claim 1 wherein the heated zone is maintained at a temperature above 360°C. for a filament travel distance of 8 to 12 inches.

7. The method of claim 6 wherein the heated zone is immediately adjacent to the extrusion point.

8. The method of claim 1 wherein the quenching gas is at a temperature of 25° to 50°C.

9. The method of claim 1 wherein the filaments from a single spinning position are split around the quenching zone into at least two threadlines, separately applying finish to each threadline and taking up said threadlines as separate yarns.

10. The method of claim 1 wherein the filaments from a single spinning position are split around the quenching zone into at least two threadlines, separately applying finish to each threadline and recombining said threadlines prior to drawing into a single yarn.

* * * * *